United States Patent [19]

Swanson

[11] Patent Number: 4,479,596

[45] Date of Patent: Oct. 30, 1984

[54] CARRYING CASE FOR PORTABLE ELECTRONIC PAGING DEVICES

[76] Inventor: Albert W. Swanson, 911 Simpson St., Evanston, Ill. 60201

[21] Appl. No.: 506,211

[22] Filed: Jun. 20, 1983

[51] Int. Cl.[3] ..... A45C 11/00

[52] U.S. Cl. ..... 224/236; 224/240

[58] Field of Search ..... 224/236, 240, 250, 901; 206/259, 273, 92, 93; 150/52 J, 52 R; 340/311.1

[56] References Cited

U.S. PATENT DOCUMENTS

D. 104,572 5/1937 Lewis ..... 224/236 X 3,949,916 4/1976 Yount ..... 224/240

4,119,249 10/1978 Hanson ..... 224/236

*Primary Examiner*—Steven M. Pollard

*Attorney, Agent, or Firm*—Wallenstein, Wagner, Hattis, Strampel & Aubel, Ltd.

[57] ABSTRACT

A carrying case for portable electronic paging devices has a partitioned receptacle assembly with a first receptacle to receive the paging device and a second receptacle to positively receive and engage the device's mounting clip. A releasable strap allows the receptacle assembly to be tripped or pivoted away from the wearer while being worn by the wearer to enable the paging device's controls or indicators to be generated or read.

4 Claims, 10 Drawing Figures

CARRYING CASE FOR PORTABLE ELECTRONIC PAGING DEVICES

BACKGROUND OF THE INVENTION

The present invention relates generally to carrying cases and, more particularly, to a protective case for portable electronic paging devices.

Portable electronic paging devices, also known as "pagers" or "beepers", are small, lightweight radio receivers which typically emit an audible signal or tone when activated, that is, when a radio signal of a specific frequency has been received by it.

Such beepers or pagers are used to notify a person that someone is attempting to contact him or her. In response to the activation of the pager, the person being paged may then go to a telephone and call a central office to receive a full message.

A typical paging system has a central transmitter sending out radio signals over a given frequency range and within a defined geographic area. A subscriber to the system, wishing to contact a person carrying a pager, can access the transmitter by, for example, telephoning in a pre-assigned code number. The transmitter will then broadcast a signal on the frequency selected for use for the particular pager involved. This signal will activate the pager and will produce an audible tone, thus notifying the wearer that a message is waiting.

On some such pagers, a digital read-out screen, or dial, makes possible the transmission of a code number, telephone number, or alphanumeric message by the central transmitter, whereupon the person carrying the pager may refer to the read-out and may, for example, directly telephone the number, rather than having to call a central office for further information.

Such pagers differ from more conventional two-way communication devices, such as radios, in the sense that there is no return transmission of information from the user of the pager. Thus, no conversation takes place between the user of the pager and the central transmitting station. Instead, the pager is a receiver only, and is intended to notify a user that someone wishes to contact the user. After such notification, other, more conventional, and less portable forms of communication, such as telephones or two-way radio equipment may thereafter be used.

By their very nature, such pagers are most useful when they are carried out in the field, away from the office, thus providing an effective way to notify someone out in the field that a message is waiting. As an example, on construction sites, those in charge of directing various aspects of the construction work may typically carry such pagers onsite, to maintain contact with the central office.

The very portability of such a pager has also caused problems in day to day use. For example, it is typical that such pagers are provided with attached belt clips so that the user may mount the pager to a belt or a pocket, thus positioning the pager where the signal tone will be audible. Such mounting clips typically do not provide strong, positive mounting capabilities, and it is easy for the pager to become dislodged and thereafter damaged by being jarred loose from the user's belt or pocket and falling to the ground. On a construction site, the ground may be a number of stories up, virtually assuring substantial damage to the pager and possible personal injury to workers below.

Damage may also occur to the pager when the pager is struck, even though the pager does not become dislodged from the user's belt or pocket. This can occur when the pager is left exposed with an inadequate protective case or covering.

Prior efforts to deal with these problems have centered about providing carrying cases or other devices separately attachable to a wearer's belt and into which the pager may be inserted or onto which the pager may be clipped. The simplest of these is a sheath with a loop attached to the sheath and sized to enable a belt to be passed through the loop. Such a sheath typically is formed as a sleeve having its top open and its bottom closed off, with the dimensions of the sleeve closely approximating the dimensions of the pager. The pager is held therewithin by the friction between the pager itself and the inner walls of the sleeve, and may also be partially held thereon by the mounting clip, if any, which overlaps the outside of the sleeve and bears against it. Such carrying cases provide no positive way to retain the pager in the sleeve and quite often allow the pager to slide out, particularly after the case has been used for some time and the material forming the case has been stretched.

Another approach to the solution of this problem has been to provide a case having a window or cut-out on one wall to enable the mounting clip of the pager to overlap the wall until the lowermost portion of the clip reaches the window, wherein the lowermost edge of the mounting clip engages the window. Particularly where such a mounting clip has a lip or other projection extending across the lowermost portion of the clip, such an arrangement provides an additional measure of retaining force. However, exposing the mounting clip along the outer surface of the carrying case leaves the clip vulnerable to impact and damage. Where the clip overlaps the rear of the carrying case, the clip necessarily comes into contact with that portion of the case at which the case is mounted to a user's belt. This means that each time the pager is inserted into or removed from the case, the clip contacts the belt and gets tangled in it.

Yet another problem typified by the existing prior art is the adjustment, operation, and reading of any indicators, controls, and/or digital displays on the pager without requiring the pager to be withdrawn from its protective case. Where, for example, a digital readout on a pager is positioned along the front face plate thereof, as in the display paging device manufactured under the trade name NEC, either the pager must be removed from the case or the case removed from the belt in order to enable the user to read the digital message.

The particular problem addressed by the present invention is that of providing protection for the paging device in a manner which completely covers the device until it is activated, and then provides a quick, efficient, and convenient way to gain access to the device, to read or adjust the device, and readily and simply to return it to its fully protective posture within the carrying case.

Accordingly, the need exists for a carrying case for portable electronic devices such as the pagers heretofore discussed, wherein said pagers may be fully protected yet may also be conveniently available for use, reading, or adjustment without requiring the pager to be removed from the case or the case to be removed from the wearer's belt or pocket.

These and further objects and advantages of my invention will best be understood by referring to the accompanying drawings wherein:

BRIEF DESCRIPTION OF THE INVENTION

A carrying case for portable electronic paging devices or the like has a first receptacle within which the paging device itself closely fits, and a second receptacle to completely and protectively surround and engage the mounting clip of the paging device. A wall common dividing the first and second receptacles forms a partitioned receptacle assembly, and has a window formed therein to provide a positive locking site for the mounting clip while the outer wall of the second receptacle protects the clip from accidental disengagement or damage.

An overlapping strap or flap attached at the lowermost edge of the common wall enables the carrying case to be tipped forward while remaining attached to the user's belt to enable viewing of a digital readout positioned along the pager's front face and to enable access to the pager's operating controls. The strap overlaps the outer portion of the second receptacle and is releasably secured thereto. A belt-mounting loop is mounted on the rearmost portion of the carrying case and is releasably secured along the lowermost portion of the carrying case to enable selective mounting and demounting of the entire case from a user's belt or other web-like element of clothing.

DETAILED DESCRIPTION OF THE DRAWINGS

Figure 1:
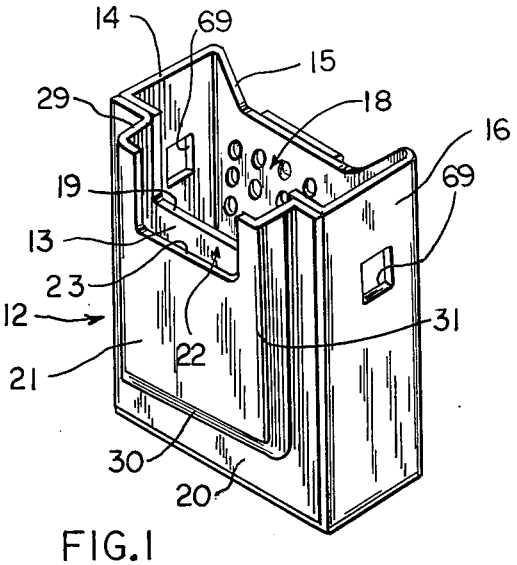
FIG. 1 is a front perspective view of a first embodiment of my invention.

Referring now to FIG. 1, the numeral 12 indicates generally a carrying case for a portable electronic paging device or similar article. Case 12 is preferably formed from leather or molded plastic of a thickness sufficient to provide useful protection to a paging device inserted therewithin.

Figure 2:
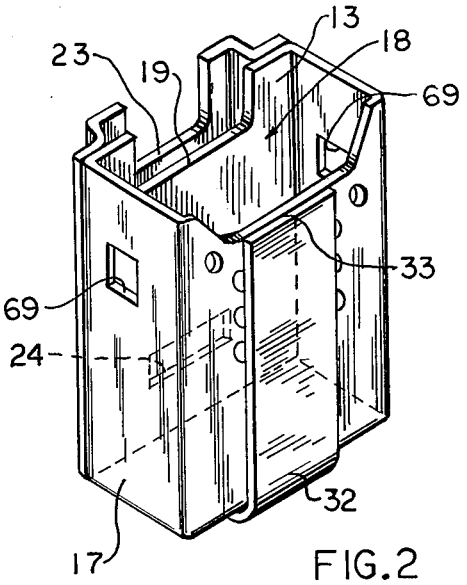
FIG. 2 is a rear perspective view of the embodiment shown in FIG. 1.
Figure 3:
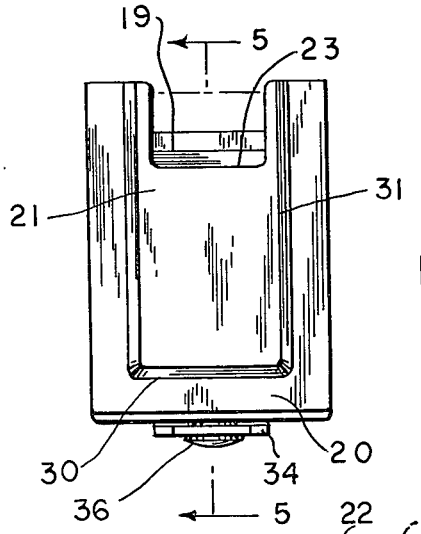
FIG. 3 is a front elevation of the embodiment shown in FIG. 1.

Case 12 has a front wall 13, a first side wall 14, a rear wall 15, and a second side wall 16, and, as seen in FIG. 2, a bottom 17. The embodiments herein illustrated typically show the case 12 as being assembled from a leather blank which is thereafter sewn or glued into the configuration shown.

Front wall 13, rear wall 15, side walls 14 and 16, and bottom 17 thus form a first, open-topped receptacle 18, which is sized to closely fit a particular paging device, enabling the device to be fully inserted into receptacle 18.

Referring to FIG. 2, front wall 13 is shown having a first cut-out 19 formed along the uppermost edge thereof. As discussed hereinabove, many paging devices of the type herein described have belt-mounting clips attached to the exterior thereof. The clip cut-out 19 is provided to enable the belt mounting clip of the paging device to overlap front wall 13 such that as the paging device is fully inserted into receptacle 18, the front wall 13 is interposed between the belt mounting clip and the paging device, directing the belt mounting clip along the outside surface of front wall 13 as the paging device is being inserted into first receptacle 18.

Figure 5:
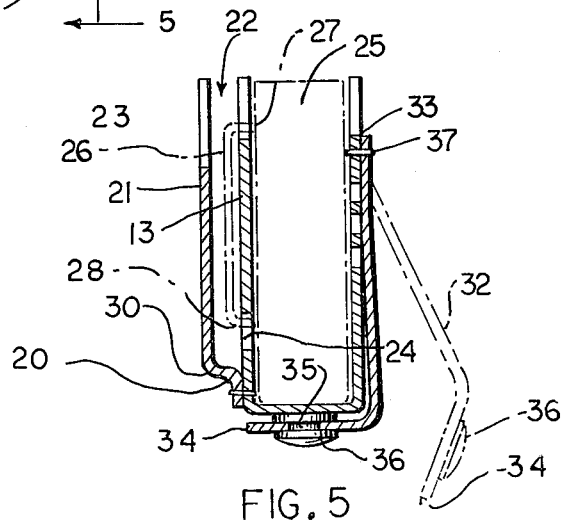
FIG. 5 is a sectional view along 5—5 of FIG. 3.

As best seen in FIGS. 1 and 5, an outer wall 20 is attached in face-to-face overlapping relationship with front wall 13. Outer wall 20 has a central portion stamped, pressed, molded, or otherwise formed to raise the central portion 21 thereof away from front wall 13 to form a second open-topped receptacle, or pocket 22. Front wall 13 is thus common to first receptacle 18 and pocket 22, with front wall 13, rear wall 15, side walls 14 and 16, bottom 17, and outer wall 20 thereby defining a receptacle assembly partitioned to create separate pager-receiving and clip-receiving cavities. As seen in both FIGS. 1 and 5, pocket 22 is formed with an open top and has a second clip cutout 23 formed thereon in essentially parallel relationship to first clip cutout 19 and terminating at a point slightly further down than first clip cutout 19.

As best seen in FIGS. 2 and 5, front wall 13 includes a clip-retaining window or aperture 24 formed therein, sized and positioned for purposes that will become more readily apparent hereinbelow.

The preferred embodiment depicted in FIGS. 1–5 is intended to accommodate a portable paging device such as that shown in phantom in FIG. 5. Paging device 25 is generally formed in the shape of a rectangular solid and includes a mounting clip 26 joined at one end 27 to paging device 25 and having a second, free end 28 biased by springs or other means to be urged toward paging device 25.

As seen in FIG. 5, clip retaining window 24 is sized and positioned to positively engage free end 28 of clip 26 to prevent accidental or unwanted removal of paging device 25 from carrying case 12. Second clip cutout 23 enables the user to reach in and disengage clip 26 from clip retaining window 24 to enable selective removal of paging device 25.

In the embodiment shown in FIGS. 1 and 5, pocket 22 is preferably formed from a single piece of material and is defined by upstanding and integral pocket walls 29, 30 and 31. Pocket 22 thus extends to cover and protect the greater portion of clip 26, and also prevents accidental disengagement of clip 26 from retaining window 24.

Figure 4:
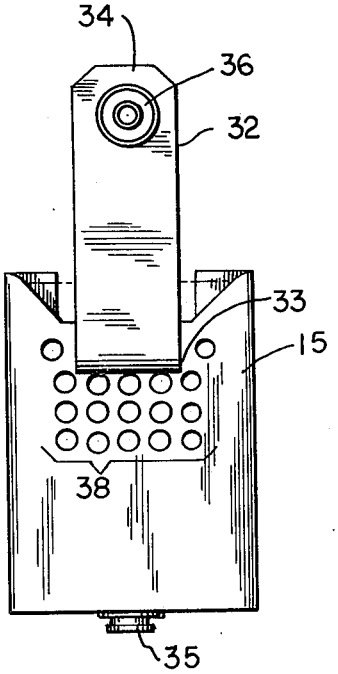
FIG. 4 is rear elevation of the device shown in FIG. 3 with the belt-mounting loop disengaged.

Referring now to FIGS. 2, 4 and 5, a belt mounting loop 32 is shown secured at 33 to rear wall 15. A free end 34 of loop 32 extends past the lowermost edge of rear wall 15 and is folded over and attachable to bottom 17. In the embodiment herein shown, male snap member 35 is attached to bottom 17, while female snap member 36 is attached to free end 34 of loop 32. As seen in FIG. 5, loop 32 may be secured at 33 by such means as one or more rivets 37. Loop 32 is shown in FIG. 5 in phantom prior to being attached to bottom 17, and is shown in solid lines in the attached position. The space between loop 32 and rear wall 15 is sized to allow insertion therethrough of a wearer's belt.

As seen in FIG. 4, a plurality of sound apertures 38 may be provided on rear wall 15 to enable the audible signal or tone generated by paging device 25 to be more easily heard.

Referring now to FIGS. 6–10, a second preferred embodiment of the present invention is therein described and contemplates use therewith of a paging device 39 of the general type having a digital readout display 40 allowing for the display of a selected number of alphanumeric characters. One such paging device is manufactured under the trade designation NEC, and a general representation of such a unit is shown in phantom in FIGS. 6 and 10.

Figure 10:
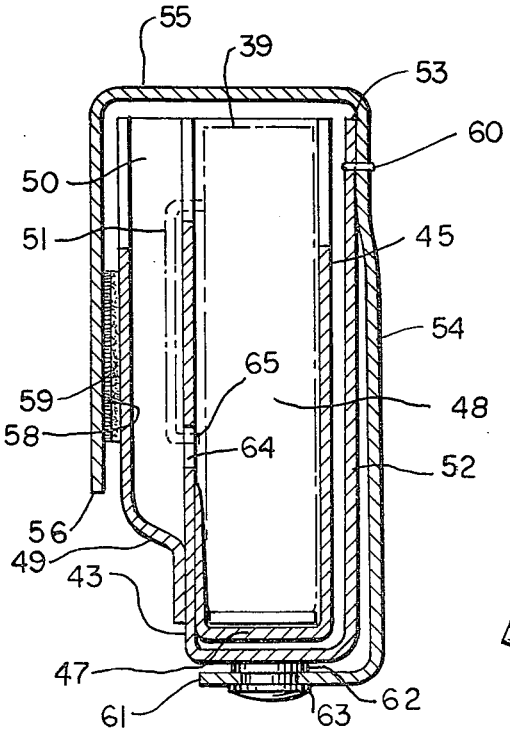
FIG. 10 is a sectional view along 10—10 of FIG. 6.

In order to allow digital readout 40 to be viewed by the wearer thereof, a carrying case assembly 41, as seen in its various details and aspects in FIGS. 6–10, has a receptacle-forming portion 42 (FIG. 9) similar in construction to the embodiment described in FIGS. 1–5, in that portion 42 has a front wall 43, a first side wall 44, a rear wall 45, a second side wall 46 and a bottom 47, forming a first receptacle 48 sized and shaped to closely fit paging device 39. As seen in FIG. 10, outer wall 49 forms a second receptacle or pocket 50 shaped and dimensioned to accommodate mounting clip 51 of paging device 39, and front wall 43 is thus common to both first receptacle 48 and pocket 50. A readout window 67, formed in rear wall 45, enables digital readout 40 to be exposed to view as will be described hereinbelow.

Figure 7:
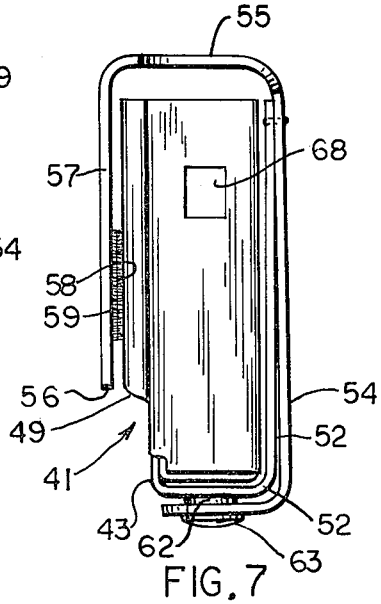
FIG. 7 is a side elevation of the embodiment shown in FIG. 6.
Figure 9:
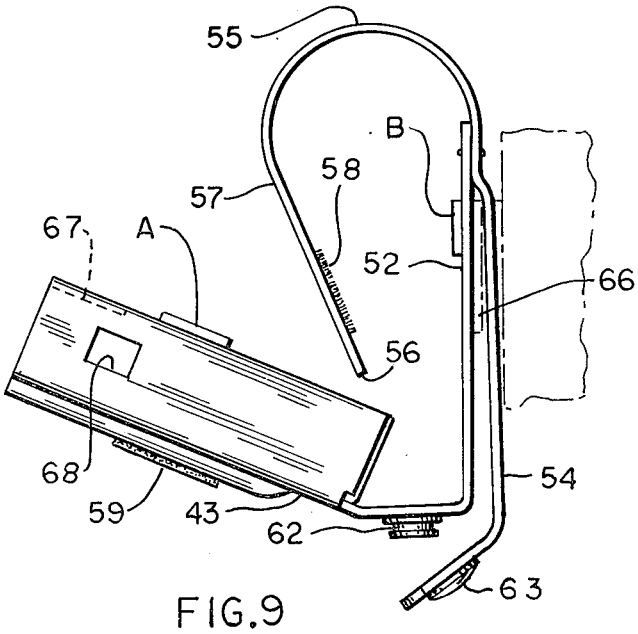
FIG. 9 is a side elevation of the embodiment shown in FIG. 6 with the carrying case pivoted into a reading position.

Referring now to FIGS. 7, 9 and 10, front wall 43 has an extension flap 52 integral and coextensive therewith, with extension flap 52 extending generally along and folded about bottom 47 and rear wall 45, terminating at an edge 53, as seen in FIG. 10.

In like fashion, belt mounting loop 54 has an overlapping extension flap 55 formed integrally and coextensively therewith, and extending to fold across the top of receptacle 48 and downwardly in face-to-face relation with pocket 50, terminating in edge 56. In the present embodiment, portion 57 of overlapping flap 55, may be releasably secured to pocket 50 as by the use of mating hook-and-loop fastener elements 58 and 59, with element 58 attached to the rear wall of overlapping flap 57 and element 59 attached directly to the front face of pocket 50.

As best seen in FIG. 10, belt loop 54 and extension flap 52 are secured one to another by, for example, rivets 60 proximate the terminating edge 53 of extension flap 52. The lowermost, or free end 61 of belt loop 54 is releasably secured to bottom 47 by, in this embodiment, a male fastener element 62 attached to bottom 47 and a female fastener element 63 attached to that portion of belt loop 54 which overlies bottom 47 and registers with male fastener element 62.

As seen in FIG. 7, when front flap 57 is attached to pocket 50 by fastener elements 58 and 59, pocket 50 and receptacle 48 are closed off, and paging device 39 is secured therewithin. As with the previously described embodiment, a clip-retaining window or aperture 64 is formed in front wall 43 in order to engage the lowermost or free end 65 of clip 50 attached to paging device 39.

Figure 6:
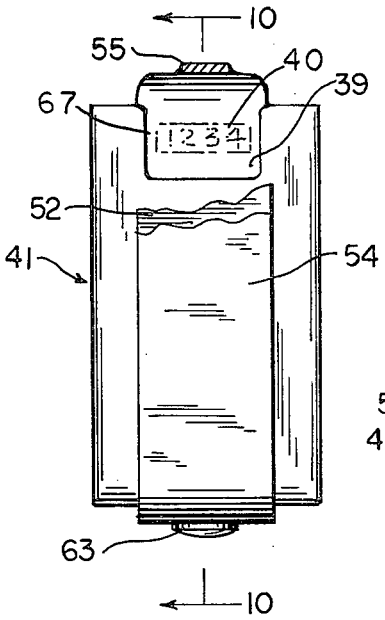
FIG. 6 is a rear elevation of a second embodiment of the present invention with a portion of the belt loop and front wall extension removed.
Figure 8:
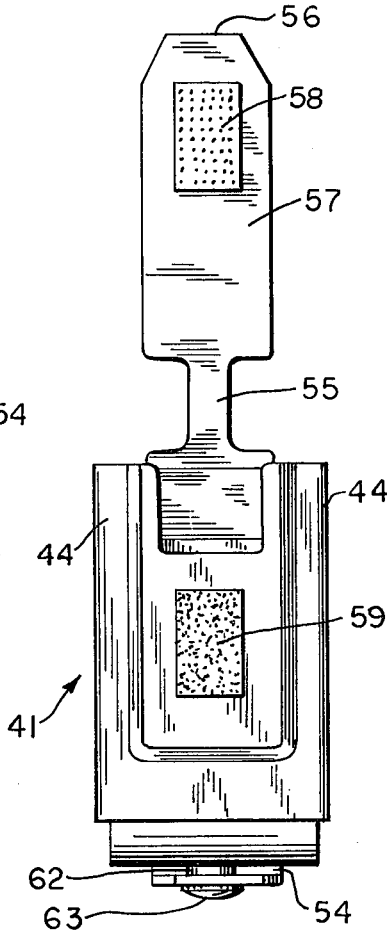
FIG. 8 is a front elevation of the embodiment in FIG. 6 witn the retaining flap fully disengaged.

Refering to FIG. 6, a portion of both belt loop 54 and front wall extension 52 are shown partially cut away to reveal readout 40 of paging device 39, as seen through window 67. In order to actually bring readout 40 into the line of sight of a user of paging device 39 without required removal of device 39 from case 41, and without requiring removal of case 41 from a wearer's belt such as shown at 66 of FIG. 9, flap 57 is disengaged from pocket 49, which allows first receptacle 48 to be tipped away from the wearer, and which enables readout 40 to be viewed through window 67. When the information transmitted by readout 40 has been noted, case 41 may then be tipped upward and resecured with extension flap 57 until its use is again required. FIG. 8 illustrates disengagement of extension flap 57 immediately prior to tipping the case forward in order to bring readout 40 into view.

As seen in FIGS. 7 and 9, and in FIGS. 1 and 2, access windows such as 68 and 69 may be provided, as necessary, to enable access to the other operating controls of paging devices such as 25 and 39, such as the on-off switch, volume control, light control, and the like. In this manner, paging device 39 may be used in an environment which fully protects the device because the device is not required to be removed from its protective case, nor is the case required to be removed from the wearer's belt or other web-like garment element in order to make full use of the paging devices' features and capabilities.

Where, for example, a pager has a digital readout located along its top, and it is desired to leave said readout uncovered, fastener element 59 may be attached to rear wall 45, and fastener element 58 may be attached to extension flap 52, as shown in phantom at A and B, respectively, in FIG. 10. Receptacles 48 and 50 may thereafter be tipped forward to provide access to other, front-mounted controls or indicators, as desired.

While the foregoing has presented certain specific embodiments of the present invention, it is to be understood that such embodiments are presented by way of example only. It is expected that others, skilled in the art, will perceive variations which, while differing from the foregoing, do not depart from the spirit and scope of the invention and the guiding principles disclosed herein as herein described and claimed.

I claim:

1. Carrying case for portable electronic paging devices, said devices of the type having a mounting clip attached thereto, and one or more controls or indicators positioned thereon, said carrying case comprising:

a front wall, a rear wall, first and second side walls, and a bottom assembled to define therewithin a first receptacle, open at its top, for closely receiving one said paging device;

means forming a second receptacle for receiving said mounting clip, said second receptacle-forming means including an outer wall member attached to and generally coextensive with the outer surface of said front wall and said second receptacle-forming means being positioned proximate said front wall to form with said first receptacle a partitioned receptacle assembly;

said outer wall including a generally vertically extending portion juxtaposed to and spaced-apart from said front wall with the remaining portion of said outer wall member joined to said front wall, said outer wall member and said front wall forming said second receptacle, open at its top, to receive said mounting clip;

a window formed in said front wall, said window being sized and shaped to positively engage the lowermost edge of said clip when said paging device is inserted into said first receptacle and said mounting clip is inserted into said second receptacle;

means for positively engaging said mounting clip to said carrying case when said mounting clip is received in said second receptacle;

means for attaching said carrying case to an article of clothing of a user; and means for providing access to said controls or indicators without requiring removal of said carrying case from said user's clothing.

2. Carrying case for portable electronic paging devices, said devices of the type having a mounting clip attached thereto, and one or more controls or indicators positioned thereon, said carrying case comprising:

a front wall, a rear wall, first and second side walls, and a bottom assembled to define therewithin a first receptacle, open at its top, for closely receiving one said paging device;

means forming a second receptacle for receiving said mounting clip;

said second receptacle-forming means positioned proximate said front wall to form with said first receptacle a partitioned receptacle assembly;

means for positively engaging said mounting clip to said carrying case when said mounting clip is received in said second receptacle;

means for attaching said carrying case to an article of clothing of a user;

means for providing access to said controls or indicators without requiring removal of said carrying case from said user's clothing, said access means including means for selectively pivoting said receptacle assembly away from said attaching means, said pivoting means including extension flap means attached along the lowermost edge of said front wall, said extension flap means extending about the periphery of said carrying case along at least said bottom and said rear wall thereof; and means to releasably secure said extension flap means to said receptacle assembly to selectively enable said pivoting to be carried out.

3. The apparatus as recited in claim 2 wherein said extension flap means extends about the periphery of said bottom, said rear wall, said open top, and said outer wall, and said securing means is positioned to releasably secure said extension flap means to said second receptacle-forming means.

4. The apparatus as recited in claim 3 wherein said extension flap means terminates at said attaching means, said attaching means including an overlapping flap means attached thereto and overlapping said open top and at least a portion of said second receptacle-forming means;

said overlapping flap means being releasably attachable to said second receptacle-forming means.

* * * * *